US005407187A

United States Patent [19]

Reil et al.

[11] Patent Number: 5,407,187

[45] Date of Patent: Apr. 18, 1995

[54] APPARATUS FOR SEPARATING STACKED SHEETS USING ROTATABLE, RECESSED SHAFTS AND VACUUM MEMBERS

[75] Inventors: Wilhelm Reil, Bensheim; Udo Liebram, Pfungstadt; Heiko Bub, Bodenheim, all of Germany

[73] Assignee: Tetra Laval Holdings & Finance S.A., Pully, Switzerland

[21] Appl. No.: 76,002

[22] Filed: Jun. 11, 1993

[30] Foreign Application Priority Data

Jun. 13, 1992 [DE] Germany ..... 42 19 445.8

[51] Int. Cl.[6] ..... B65H 5/08

[52] U.S. Cl. ..... 271/14; 271/23; 271/102

[58] Field of Search ..... 271/23, 11, 14, 99–102, 271/165

[56] References Cited

U.S. PATENT DOCUMENTS

| | | | |
|---|---|---|---|
| 1,916,723 | 7/1933 | Ferrar | 271/23 |
| 2,817,517 | 12/1957 | Wittkuhns et al. | 271/23 |
| 2,817,518 | 12/1957 | Anness | 271/23 |
| 3,395,912 | 8/1968 | Tappolet et al. | 271/23 |
| 4,253,653 | 3/1981 | Bauer | 271/22 |
| 4,375,285 | 3/1983 | Dennhardt | 271/11 |
| 4,981,235 | 1/1991 | Ferrini et al. | 221/23 |

FOREIGN PATENT DOCUMENTS

| | | | |
|---|---|---|---|
| 1956948 | 6/1970 | Germany . | |
| 2247526 | 4/1974 | Germany . | |
| 7336493 | 1/1975 | Germany . | |
| 2436354 | 2/1976 | Germany . | |
| 2429427B2 | 4/1976 | Germany . | |
| 2539200A1 | 3/1977 | Germany . | |
| 2815163A1 | 10/1979 | Germany . | |
| 3025201 | 1/1982 | Germany . | |
| 140439 | 11/1980 | Japan | 271/11 |

*Primary Examiner*—Cheryl L. Gastineau
*Assistant Examiner*—Boris Milef
*Attorney, Agent, or Firm*—Michael L. Dunn; Robert P. Simpson

[57] ABSTRACT

A separating apparatus having a magazine in which stacked sheets made of plastics material or the like are arranged, and having movable suction means for moving the separated sheets to a workplace, where the sheets in the stack are supported in a horizontal position by holding means on the bottom edge of the magazine, and therebetween the bottom most sheet is freely disposed and is accessible to the suction means. The holding means comprises a rotatably driven shaft arranged along the two bottom edges of the magazine, the cross-section of which shaft, in the region of the length of the sheet, is recessed so as to form a shoulder, the depth of the shoulder being equal to the thickness of the sheet to be separated, and arranged approximately in the center between the edges of the magazine are the suction means which are able to move toward and away from the bottom sheet.

8 Claims, 4 Drawing Sheets

Figure 1:
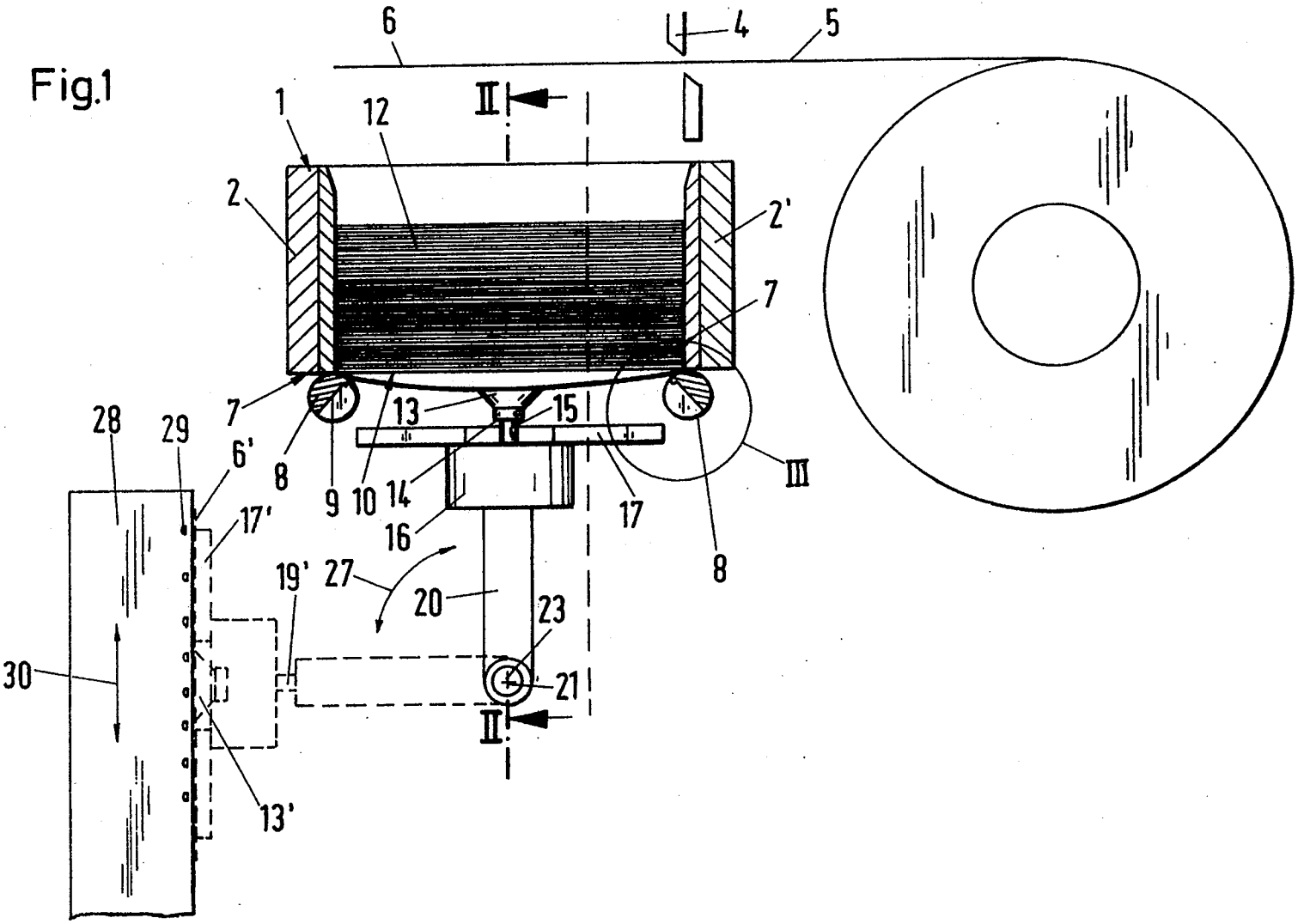

APPARATUS FOR SEPARATING STACKED SHEETS USING ROTATABLE, RECESSED SHAFTS AND VACUUM MEMBERS

The invention relates to an apparatus for separating sheets made of plastics material, cardboard or the like which are stacked in a magazine, the apparatus having at least one movable suction means and for the purpose of transporting the separated sheets to a workplace, wherein the sheets in the stack are supported so that they are in a substantially horizontal position by holding means on the bottom edge of the magazine, and therebetween the bottommost sheet is freely disposed and accessible to the suction means.

With somewhat stiffer sheets made of cardboard, plastics material or similar materials the problem often exists when separating these kinds of papers, sheets or blanks when the stack is being processed. This separating operation is usually difficult if the sheets or papers become accidentally stuck together.

Separating apparatus is known wherein pushing means displace the respective bottommost sheet in a direction over the lateral bottom holding means until the sheets have lost their hold on the edge in question, and hang down freely into the opening, whereupon an oppositely disposed further pushing means performs an oppositely disposed pushing movement and also pushes down the oppositely disposed edge of the sheet from its lower holding means, so that the sheet can then fall freely down into further devices. As a result of the weight of a large stack to the respective bottommost sheen. This sheet sticks with varying degrees of firmness to the sheets on top of it, resulting in the pushing means holding a plurality of sheets at one and the same time, so that the separating operation is not reliably ensured. Apparatus has also been constructed where two pushing arrangements of this kind are disposed beneath one another in order to guarantee the separating operation in the subsequent second stage.

However, particularly in cases when corrugations occur in the longitudinal extent of the edge of the respective sheet, which often happens, in particular, with sheets made of plastics material, the pushing means of the known separating apparatus only engage in point-like manner, or they do not find any point of engagement at all, since at the very place where the pushing means is disposed, the bending up movement of the edge of the sheet of paper has produced a gap. Separating by way of this apparatus is therefore unreliable for sheets with corrugated edges.

Separating the bottommost sheet in a stack by means of suction means brings no solution either because due to the fact that the bottommost sheets stick together by being pressed together or by vacuum effect, a plurality of sheets is often drawn off simultaneously.

In the case of metal sheets, a method is already known of arranging shafts with longitudinally arranged grooves, which shafts rotate in mutually oppositely disposed directions, on the two bottom oppositely disposed edges of the magazine, so that when the edges of the sheets or the oppositely disposed outer edges of the metal sheets engage with the grooves of the shafts a buckle load is produced so that the sheets are bent elastically and are then released when the shafts further rotate. As a result of them bending, the sheets become displaced relative to each other, so that the adhesion between them or the phenomenon of them sticking together is interrupted when two pairs of shafts are arranged vertically beneath one another at a spacing apart. The grooves of the bottom pair of shafts then engage with the next sheet alone which falls into a magnetic field when it is subsequently released, and this causes the sheets to be held at vertical spacings apart and subsequently to be transported beneath the magnetic field between two vertical screw conveyors which are responsible for reliably performing the last separating operation.

The known apparatus can only be used with very stiff or hard metal sheets, or the like, which neither have to be supported on their surface nor conveyed from the top to the bottom by other auxiliary means, but which fall down into the next station entirely by virtue of their own weight. In addition, reliable separation is only achieved by the mutual switching of two pairs of shafts with in phase, reciprocal and continuous rotational movement with a magnetic field disposed downstream and pairs of screw conveyors. An apparatus of this kind is considerably expensive.

The aim of the invention therefore is to create a separating apparatus of the kind mentioned in greater detail in the introduction and with which the sheets made of plastics material, cardboard or the like can be separated reliably using simple means and are preferably able to engage with the afore-mentioned suction means in an accurately reproducible position. .

Part of the concept of the invention is to make use of suction means to withdraw the bottommost sheet, despite the fact that the use of suction means for separating is already known per se with conventional apparatus. The special feature of the present invention is the idea of combining per se known means with new means to surprising effect.

With respect to the afore-described apparatus, the problem according to the invention is solved in that along at least one of the two bottom edges of the magazine is arranged a shaft driven rotatably and in the form of a holding means, the cross-section of which shaft is recessed in the region of the length of the sheet to form a shoulder, the depth of the shoulder being equal to the thickness of the sheet to be separated, and arranged approximately in the centre between the edges of the magazine is a suction means which can move towards and away from the sheet from below. By virtue of the features according to the invention, the respective bottommost sheet falls into the afore-mentioned shoulder-like recess of the, at least, one shaft, and, in the case of a curved edge of the sheet, this is also grasped hold of laterally by the shoulder in many places in such a way that it is certain that only the bottom-most sheet is held when the shoulder rotates in the direction of the oppositely disposed holding means and is subjected to a bending movement due to the reduction in the gap relative to the oppositely disposed holding means. The shoulder has a small edge, which, prior to engagement with the edge of the sheet, is disposed in the extent of the height of the stack, and which is thus arranged in a substantially vertical position, and it further has a contact surface which is disposed at an angle of about 90° thereto on which the edge of the sheet comes to lie. When the edge of the shoulder rotates between these two surfaces in the direction of the oppositely disposed holding means, in addition to the gap relative to the oppositely disposed holding means being reduced, the afore-mentioned contact surface is also inclined downwardly towards the opening between the two holding means. As a result, it is even easier to withdraw the bottommost sheet, and the edges of the sheets are protected in the region of the shoulders of the shaft. The fact that the bottommost sheet is withdrawn by the use of the suction means permits reliable separation, wherein the position of the sheet relative to the suction means is preferable set in such a way that it is reproducible.

The separating operation is carried out particularly favourably, if, according to the invention, both mutually oppositely disposed holding means are also formed by shafts which are partially recessed in their cross-section and which are driven to rotate reciprocally synchronously to each other. The rotational movement of the shafts about their longitudinal axes is expediently oscillating in nature, wherein the arc of rotation of the oscillatory movement is only within a range of between 10° and 40°, wherein it has even been established in practice that rotational movement through an angular range of from 20° to 30° gives good results. This means that the apparatus is able to separate a large number of sheets per unit of time.

It is also advantageous according to the invention if the shaft adjacent to the shoulder has a recess of approximately semi-circular cross-section. Usually, a normal shaft is round, and its outside surface is imagined as being like a cylindrical casing. The shaft extends beneath the edge of the magazine over the entire length of the magazine and over its side walls, and is thus clearly longer than the longitudinal edge of the sheet to be separated. For the sake of simplifying its manufacture, the afore-mentioned shoulder can extend beyond the length of the edge of the sheet and possibly even beyond the corresponding length of the magazine. The recess of semi-circular cross-section, on the other hand, is only provided over the length of the edge of the sheet, simply for reasons of stability to provide accurate movement of the shaft. The shaft is flattened in the region of the sheet which is to be separated, so that a gap is produced between the shafts which is always wider than the smallest gap between two oppositely disposed shafts of circular cross-section, without the recess according to the invention. A larger space is, however, advantageous for movement of the machine elements, as will be described hereinafter, which would otherwise be incapable of comparably good displacement.

With another advantageous embodiment of the invention, the suction means is movable in translatory manner by means of a first drive, and the first drive is fixed to a second drive for carrying out rotational movement. In this way, the suction means is movable in a straight line, so that it can be moved from the bottom through the opening of the magazine between the oppositely disposed holding means towards the bottom surface of the bottommost sheet. The first drive can then move the sheet which has been sucked in by vacuum in a straight line in the opposite direction to the travelling suction means away from the stack. Since this first drive means is now fixed to a second rotary drive, the suction means, together with the sheet which is stuck to it and which is to be separated, can make another rotational movement, and transport the separated sheet to another place, e.g. a workplace where the separated sheet is removed and subjected to further operations.

With one preferred embodiment, the sheets which are to be separated are rectangular and sometimes greater in length than in width, so that it is expedient to provide shafts of corresponding length to the holding means on the bottom of the magazine, and accordingly to arrange a plurality of suction means in a row behind one another, so that the elongate sheet can be held and gripped over its entire length at a plurality of locations. Therein, it is expedient to arrange two so-called first drives at a spacing above the length of the sheet to be separated, but a first drive could also be provided for each suction means. It is particularly expedient to provide two first drives which simultaneously displace four suction means by way of suitable holding means in any way, wherein both first drives clearly have to be moved in phase. The second drive for rotational movement can simultaneously rotate the two first drives (likewise in phase relative to each other) and rotate all suction means of a row or of a plurality of rows in phase and simultaneously.

With one expedient embodiment, it is provided according to the invention that a pressure plate which is movable in translatory fashion is arranged on the first drive, on which pressure plate the suction means is movable in a straight line in the same direction as the pressure plate by means of a third drive. The above-mentioned machine element is a pressure plate with this embodiment which is arranged on the side which faces the sheet to be separated and which can be placed against that sheet if the one single suction means or the plurality of suction means is/are withdrawn in a straight line/by translatory movement relative to the pressure plate by way of the afore-mentioned third drive. To this end, the pressure plate preferably has openings into which the suction means is/are able to be engaged so that the surface of the pressure plate is flush, smooth or flat and so that the sheet to be separated can be arranged on it accordingly. The afore-mentioned drive is thus expediently arranged on the rear of the pressure plate which is remote from the magazine, so that the respective suction means can be withdrawn into the outer contour of the pressure plate (by way of the third drive), and the pressure plate can then be rotated with all its suction means and their third drives by the second drive to transport away the separated sheet.

The rotational movements of the one shaft, or of both shafts, which are synchronous to each other, on the edge of the magazine, on the one hand, and the transport shaft of the second drive, on the other hand, are effected by pneumatically, hydraulically or mechanically controlled levers.

It is also favourable according to the invention if at least one wall of the magazine is arranged so that it is displaceable vertically to the plane of the wall for the purpose of centering the stacked sheets. Preferably, one wall of the magazine is pressed by way of an air cylinder gently in the direction of the oppositely disposed stationary magazine wall, and the stack of the sheets which are to be separated is thereby centred advantageously so that the position of each of the sheets to be separated is always the same and is accurately reproducible. This is considerably advantageous with respect to further accurate positioning of the sheet in the subsequent workplace.

Figure 2:
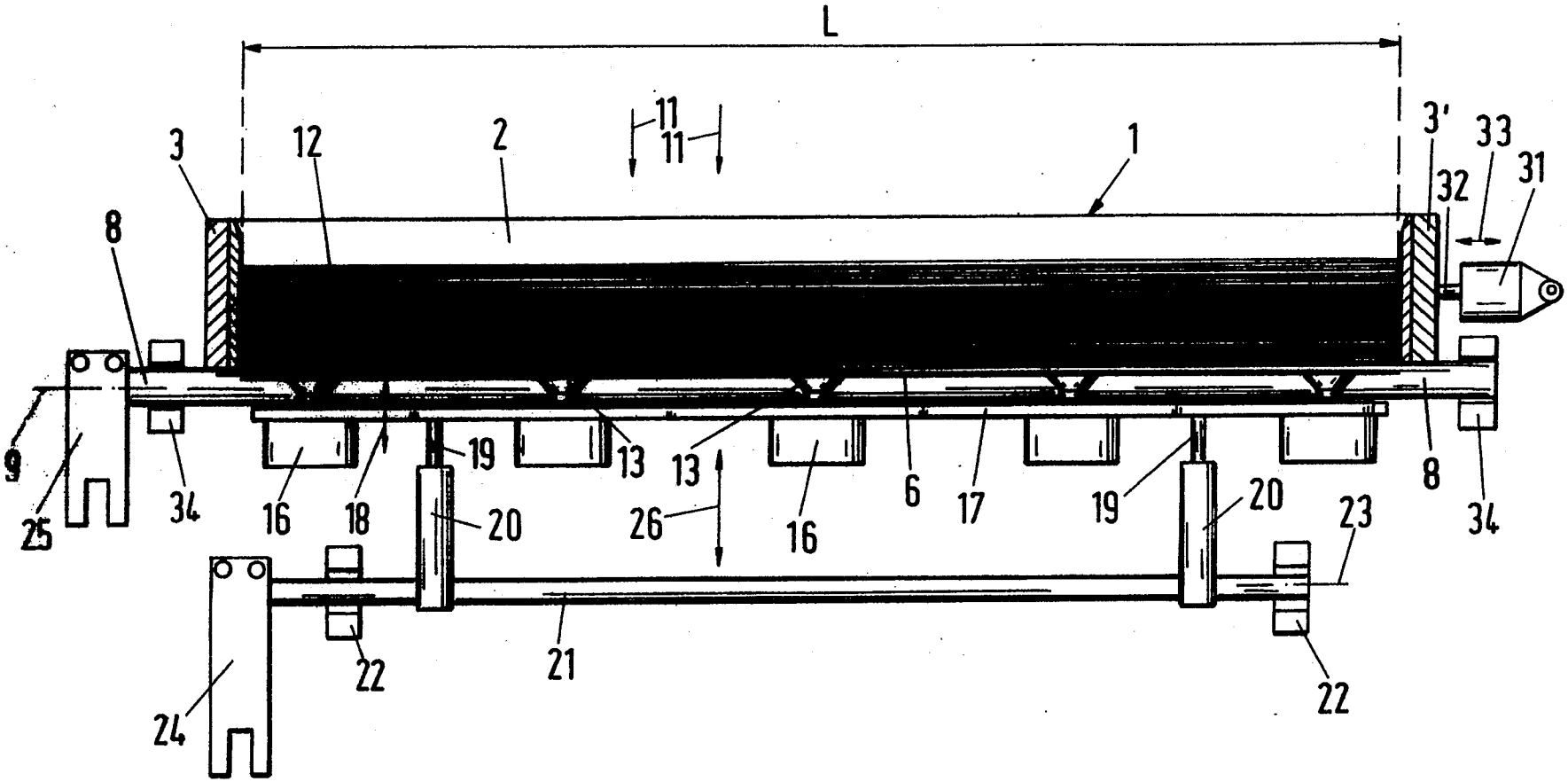
Figure 3:
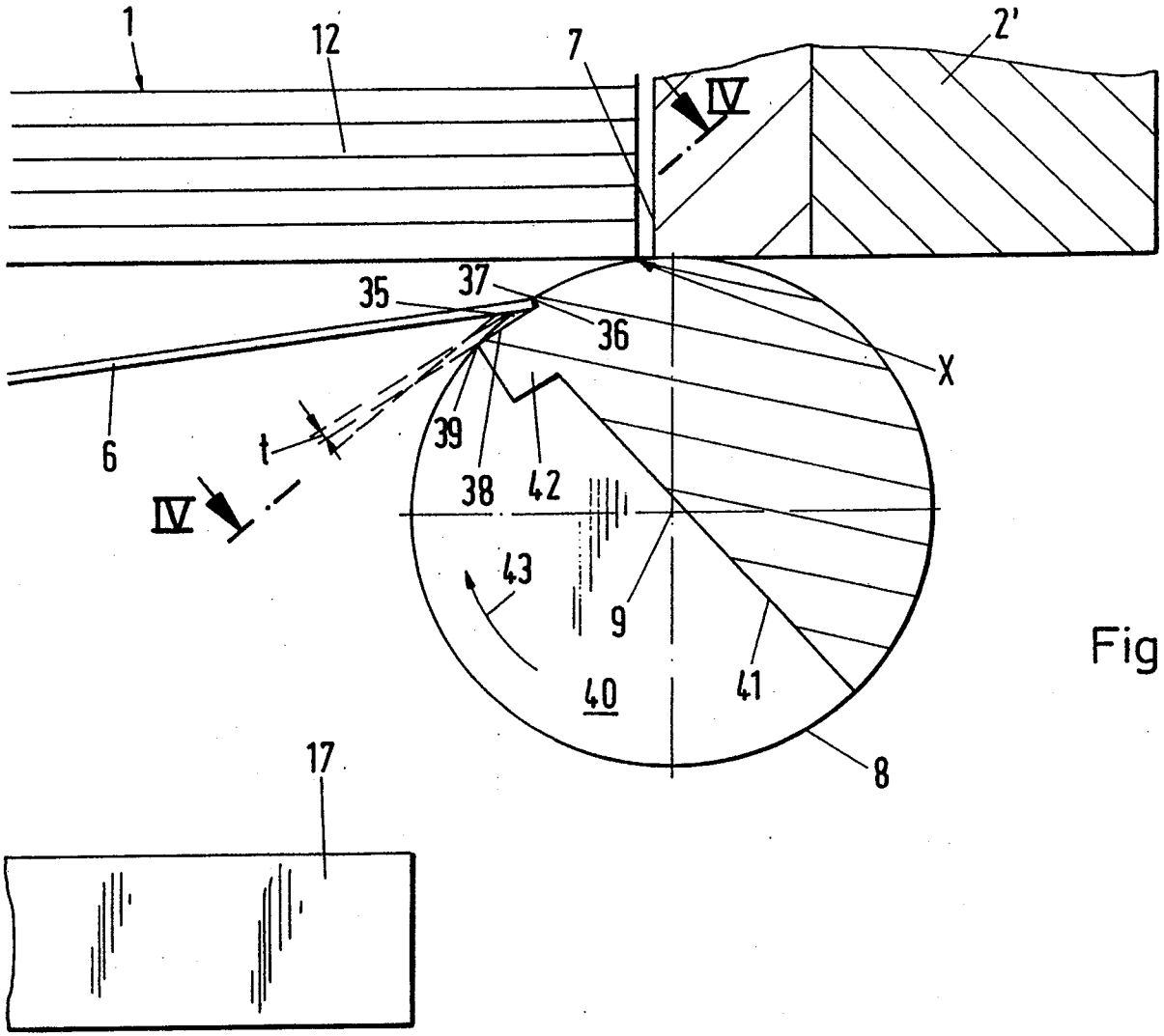
Figure 4:
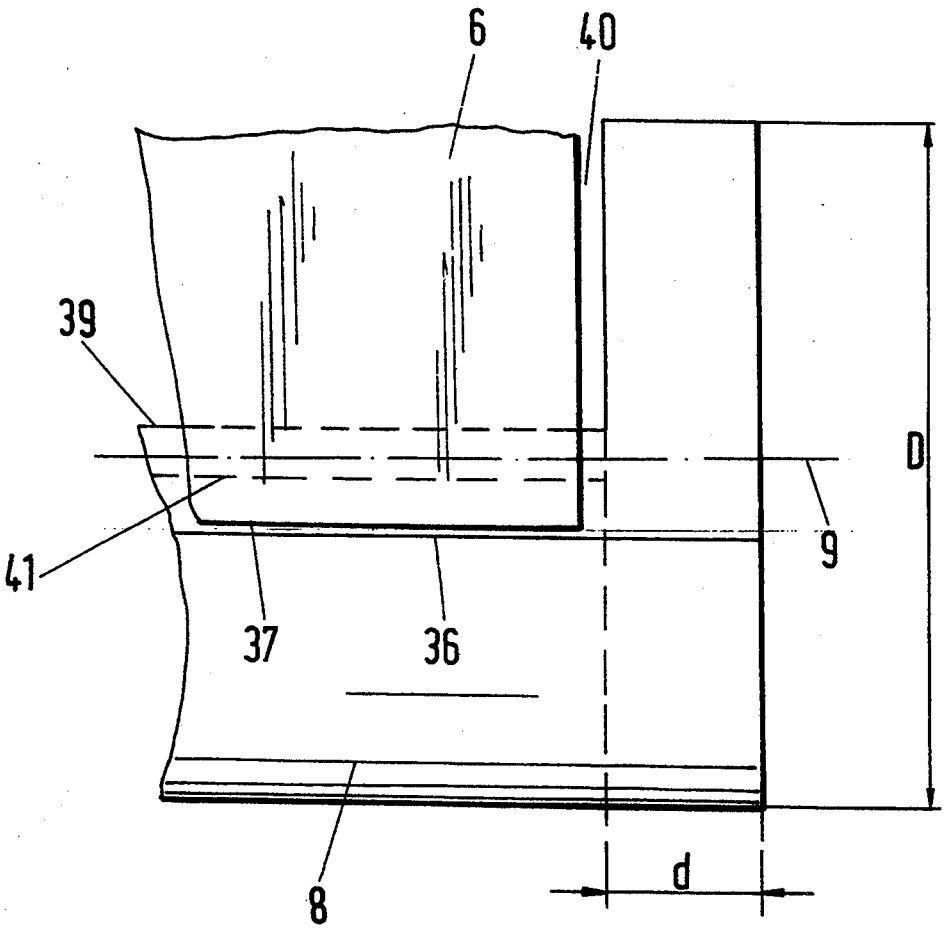

Whilst with some embodiments, it is sufficient to provide only one of the two holding means on the bottom edge of the magazine in the form of a shaft with a shoulder and preferably with a semi-circular recess, with special instances of application it can be necessary to arrange two oppositely disposed shafts in the form of holding means on the lower edge of the magazine. It cannot be avoided that some plastics sheets which are produced by being cut from a strip, for example, have tolerances which have been shown to act up to 100% in one place if only one holding means is designed in the form of a shaft. However, if both holding means are designed as shafts, then the tolerance is distributed on both sides, is thus halved and can virtually be dismissed.

further advantages, Features and possible applications of the present invention will emerge from the following description, given in conjunction with the accompanying drawings, wherein:

FIG. 1 is an illustrative cross-sectional view through the magazine with the suction means with drives arranged therebeneath, wherein a subsequent workplace is indicated to the left, FIG. 2 is a sectional view along the line II—II in FIG. 1, FIG. 3 is an enlarged individual view off the detail III in FIG. 1, and FIG. 4 is a partly broken away plan view along the line IV—IV in FIG. 3.

FIGS. 1 and 2 show the main parts of the preferred embodiment shown here of a separating apparatus, given by way of example. The magazine which is generally denoted by the reference numeral 1 is to be imagined as being rectangular in the plan view, and it has two longitudinal walls 2, 2' and two transverse walls 3, 3', wherein each wall consists of two parallel wall portions, which are not shown here in greater detail, however. The walls 2, 2', 3, 3' are vertical (perpendicular) so that they can be loaded from above with plastics sheets 6 produced by a cutting device 4 from a web 5. Therein, the bottommost sheet 6 falls down as far as the bottom edges 7 of the magazine 1, beneath which two shafts 8 are arranged parallel to ,one another. The axis of rotation 9 of the shafts 8 is disposed therein so that it is almost in the extension of the inner surface of the walls 2, 2', displaced only slightly outside the opening 10, as can be seen more clearly in FIG. 3. The opening 10 extends from the inside bottom edge of the edge 7 of the one longitudinal wall 2 as far as the oppositely disposed bottom left edge of the right-hand edge 7 of the right-hand longitudinal wall 2', and is rectangular in the plan view in the direction of the arrow 11 (FIG. 2). The respective shaft 8 makes contact with the bottom edge 7 of the side wall 2, 2' of the magazine 1, whereby contact points X (FIG. 3) and likewise on the oppositely disposed side (not shown) result; these are usually small contact surfaces since the sheets are not one hundred per cent rigid and straight. Instead, they must be elastically flexible since otherwise the separating apparatus described here would not function.

The two shafts 8 are, so to speak, the holding means on the bottom edge 7 of the magazine 1, on which the sheets 6 are supported.

One sheet 6 after the other falls into the box-like space of the magazine 1 until the stack 12 reaches the approximate weight shown in FIGS. 1 and 2.

In the centre, beneath the opening 10 five pneumatic suction means 13 are disposed in a row behind one another, the front ones of which are shown in FIG. 1, whilst in the cross-sectional view of FIG. 2 all five suction means 13 are shown. They are disposed in front of the left fear shaft 8 according to FIG. 2.

Each suction means 13 is arranged on the outer end 13 of the piston rod 15 of a so-called third drive 10, so that an equal number of third drives 16 are provided as suction means 13. These third drives 16 are fixed to a pressure plate 17 which extends over almost the entire length (L) and transversely thereto almost over the entire width of the sheets 6. This pressure plate 17 thus holds the respective third drive 16 and permits relative movement of the suction means 13 in the direction of the two-directional arrow 18 in a straight line upwards and vertically downwards for withdrawal purposes.

The pressure plate 17 is, in turn, fixed to the outer ends of further piston rods 19 off a so-called first drive 20 which is fixed in the form of an air cylinder 20 to a transport shaft 21 and which is supported in two bearings 22 according to FIG. 2. The axis of rotation of the transport shaft 21 is denoted by the reference numeral 23.

The rotational movement of the transport shaft 21 is performed by way of a controlled lever 24; rotation of the respective shaft 8 is by way of a lever 25. The drives of the levers 24 and 25 are not shown. Arranged in the longitudinal extent of the transport shaft 21 are two air cylinders 20, so that the pressure plate 17 is held securely and reliably in two places. Apart from the movement of the suction means 13 relative to the pressure plate 17, as marked by the two-directional arrow 18, the so-called first drive 20 (air cylinder) can also move the actual pressure plate 17 relative to the transport shaft 21 in the direction of the two-directional arrow 26. The stroke movement of the translatory movement 26 upwards and downwards of the pressure plate 17 is greater than the stroke movement of the upwards and downwards movement in a straight line of the suction means 13 along the two-directional arrow 18.

In addition, the rotational movement of the transport shaft 21 in the direction of the curved two-directional arrow 27 is responsible for moving the suction means 13 from the position shown in FIG. 1 by solid lines into the position marked by broken lines where the suction means is denoted by the reference numeral 13'. A heated plate 28 is shown adjacent thereto with a plurality vacuum openings 29, wherein the vacuum openings are to be imagined as being arranged on the right-hand surface. This heated plate 28 is movable upwards and downwards vertically in the direction of the two-directional arrow 30.

The sheets 6 which are to be separated in the stack 12 are centred by displacing the right-hand rear side wall 3' of the magazine 1 by the aid of an air cylinder 31, which, by way of a piston rod 32, permits displacement of the side wall 3' along the two-directional arrow 33.

The respective shaft 8 is supported in bearings 34. We will now turn to the design of the respective shaft 8 and reference will be made in this respect to FIGS. 3 and 4. To the bottom left in FIG. 3 it is possible to see the right-hand end of the pressure plate 17 which is likewise broken off to the left, like the separate sheet 6 above it and the stack 12 in the magazine 1. The shaft 8 is disposed beneath the edge 7 thereof, the diameter D of which shaft is shown in FIG. 4.

Whereas the shaft 8 is left substantially circular on the respective outer length D (FIG. 4) (however, the shoulder 35 can pass through it), the cross-section of the shaft 8 shown in FIG. 3 is provided with a recess which forms a shoulder 35.

The depth t of the recess is equal in thickness to the sheet 6 which is to be separated. The radially arranged plane 36 of the shoulder therefore represents a very short surface, i.e. it corresponds to the height t. This plane is marked in the view taken in FIG. 4 as a line 36. The right-hand edge 37 of the sheet 6 rests against this slightly prior to, or at the latest after, the start of the rotational movement of the shaft 8. To clarify this, the right-hand edge 37 of the sheet 6 which appears as a line is shown as being disposed at an exaggerated spacing away from the edge 36.

Disposed vertically to the narrow surface 36 of the shoulder 35 is the somewhat larger contact surface 38 of the shoulder 35 which extends as far as the edge 39 and which makes contact with the circle of the shaft 8 at the point 39 shown in FIG. 3. This longitudinal edge 39 of the shoulder 35 is shown in FIG. 4 as a line which is only marked faintly beneath the sheet 6. As viewed from above in the direction of the line IV—IV, the shoulder 35 thus extends from the line 37 to the line 39. It is possible to draw this shoulder over the circular end region d of the shaft 8 towards the outside. The apparatus operates just as well, however, if the peripheral face is really like a cylindrical casing over the ends d of the shaft 8.

In FIG. 3 it can be seen that the shaft 8 is provided adjacent the shoulder 35 with a semi-circular recess 40 which is shown in FIG. 3 as a partially circular surface, whilst in FIG. 4 it is possible to see an empty space which is part of recess 40. This semi-circular recess 40—as viewed in cross-section—only extends over the length L of the respective sheet 6, and thus not beyond the circular end region d of the shaft 8. The sense and purpose of this semi-circular recess 40 is to create a space beneath the opening 10, as can be seen in FIG. 1. The pressure plate 17 is supposed to be capable of moving through this space up towards the bottommost sheet 6, so that the removal stroke movement of the suction means 13 from the surface of the pressure plate 17 along the two-directional arrow 18 can only be very short (small, stroke movement). In addition, the space shown in FIG. 1, in particular, on the left-hand side, is supposed to enable the pressure plate 17 to move rotationally, together with the sheet 6 fixed by way of the suction means 13 in the direction of the arrow 27 down to the left.

If the cross-sectional view of the shaft 8 in FIG. 3 is studied more closely, it can be seen that the inner plane 41 of the semi-circular recess 40 does not open directly into the edge of the shoulder 35 in the radial extent. Instead, a lug 42 is formed between the shoulder 35 and the semi-circular recess 40 which extends along the whole of the semi-circular recess 40 and the upper side of which forms the contact surface 38 of the shoulder 35. The outer upper edge of this bar-like lug 42 is the afore-mentioned edge 39 which is tangentially inside the cylindrical outside surface of the shaft and which does not project over the outer contour of the circle of the shaft 8.

FIG. 4 shows the plane 41 next to the semi-circular recess 40 as an unseen faint line.

During operation, when the pressure plate 17 is withdrawn, the suction means 13 is pivoted by way of the second drive 21, 24 into the position shown to the top right and marked by solid lines in FIG. 1. The first drive 19, 20 is then actuated, until the pressure plate 17 is moved upwards from the position shown by the solid lines until the piston rod 19 is seen which is seen in FIG. 1 in the position and denoted by the reference numeral 19'. The respective third drive 15, 16 is then actuated, so that the suction means 13 can be moved in the direction of the arrow 18 up as far as the lower side of the sheet 6 which has been offered by the shafts 8.

From the straight condition, in which the outer edges 37 of the respective bottommost sheets 6 at the location X in FIG. 3 come to rest on the respective shaft 8, the sheet 6 is brought into the bent position by the shaft 6 being moved in the direction of the curved arrow (FIG. 3) 43 far enough for the rear edge 36 of the shoulder 35 to move some way beyond the point of contact X (the oppositely disposed shaft must rotate in phase in the opposite direction). The outside edge 37 of the sheet 6 then falls into the shoulder 35. The shaft 8 ceases its rotation, and the rotational movement changes direction. The shaft then rotates in the opposite direction until it reaches the position shown in FIGS. 1 and 3, for example, where the rotational movement of the shaft 8 ceases.

The suction means 13 then hold the underside of the sheet 6, vacuum is applied and the sheet 6 can be released by the shoulders 35 of the two shafts 8 by the piston rod 15 withdrawing by means of the air cylinder 16, and can be placed downwards against the pressure plate 17.

The first drive is then switched on, and the piston rods 19 withdraw the pressure plate radially with reduction to the radius of rotation. The second drive is then switched on, whilst the transport shaft 21 rotates in the direction of the curved arrow 27 (FIG. 1) to the Left in a downwards direction through about 90°, so that the pressure plate adopts the marked position. In that position it is possible to see the pressure plate 17' with the sheet 6' held by way of the suction means 13'. The first drive as been switched on in the meantime, so that the piston rod 19' is moved radially outwardly, with the result that the sheet 6' comes into position on the surface of the heated plate 28. The vacuum can then be placed over the nozzle openings 29 whilst the suction means 13' are supplied with air. At this moment the sheet 6' is transferred to the heated plate 28 so that after the piston rod 19' has been withdrawn, the pressure plate 17' can be withdrawn to the short radius position after "pressure", and then can pivot back in the direction of the arrow 27 into the position shown by the solid line in FIG. 1. The cycle then begins again.

What is claimed is:

1. An apparatus for separating a bendable sheet of material from the bottom of a stack of sheets, said apparatus comprising:

a) a magazine for retaining said stack, said magazine having at least two walls and at least two lower edges;

b) spaced oppositely disposed holding means proximate said lower edges for retaining the stack of sheets in a substantially horizontal position such that the bottom sheet of said stack is accessible between the holding means, at least one of said holding means comprising a rotatable shaft having a cross section which is recessed in the region of a lengthwise edge of the bottom sheet, to form a shoulder in the shaft, the depth of which is sufficient to engage the lengthwise edge of only the bottom sheet to be separated; and which shaft, when rotated, bends said bottom sheet;

c) a suction means which is movable toward and away from the bottom of said stack between the edges of the magazine and which can engage and remove said bottom sheet;

d) means for rotating said shaft; and e) means for moving said suction means; wherein the suction means is movable in a translatory fashion by means of a first drive, of the means for moving the suction means, and is movable in a rotary motion by means of a second drive, of the means for moving the suction means, which is attached to the first drive, and wherein a pressure plate is attached to the first drive which is movable in translatory fashion on which plate the suction means is movable by means of a third drive, in the same direction as the pressure plate.

2. An apparatus for separating a bendable sheet of material from the bottom of a stack of sheets, said apparatus comprising:

a) a magazine for retaining said stack, said magazine having at least two walls and at least two lower edges;

b) spaced oppositely disposed holding means proximate said lower edges for retaining the stack of sheets in a substantially horizontal position such that the bottom sheet of said stack is accessible between the holding means, wherein both of said holding means comprise a rotatable shaft having a circular outer contour and a cross section which is partially recessed in semi-circular cross section in the region of a lengthwise edge of the bottom sheet, adjacent to a shoulder in the shaft, the depth of which is sufficient to engage the lengthwise edge of only the bottom sheet to be separated, and a lug between the shoulder and the recessed cross section which extends tangentially inside the circular outer contour of the shaft;

c) a suction means which is movable toward and away from the bottom of said stack between the edges of the magazine and which can engage and remove said bottom sheet;

d) means for rotating said shafts in a reciprocal manner synchronously to each other, such that when the shafts are so rotated, the bottom sheet is bent; and e) means for moving said suction means; wherein the suction means is movable in a translatory fashion by means of a first drive, of the means for moving the suction means, and is movable in a rotary motion by means of a second drive of the means for moving the suction means, which is attached to the first drive, wherein a pressure plate is attached to the first drive which is movable in translatory fashion on which plate the suction means is movable by means of a third drive, in the same direction as the pressure plate.

3. Apparatus as recited in claim 2 wherein at least one wall of the magazine is displaceable for the purpose of centering the stacked sheets in the magazine.

4. An apparatus for separating a bendable sheet of material from the bottom of a stack of sheets, said apparatus comprising:

a) a magazine for retaining said stack, said magazine having at least two walls and at least two lower edges;

b) spaced oppositely disposed holding means proximate said lower edges for retaining the stack of sheets in a substantially horizontal position such that the bottom sheet of said stack is accessible between the holding means, wherein both of said holding means comprise a rotatable shaft having a circular outer contour and a cross section which is partially recessed in semi-circular cross section in the region of a lengthwise edge of the bottom sheet, adjacent to a shoulder in the shaft, the depth of which is sufficient to engage the lengthwise edge of only the bottom sheet to be separated, and a lug between the shoulder and the recessed cross section which extends tangentially inside the circular outer contour of the shaft;

c) a suction means which is movable toward and away from the bottom of said stack between the edges of the magazine and which can engage and remove said bottom sheet;

d) means for rotating said shafts through an acute angle in a reciprocal manner synchronously to each other, such that when the shafts are so rotated, the bottom sheet is bent; and, e) means for moving said suction means.

5. The apparatus according to claim 4, wherein the sheets comprise a material selected from the group consisting of plastic and cardboard.

6. The apparatus of claim 4, wherein the suction means is movable in a translatory fashion by means of a first drive, of the means for moving the suction means, and is movable in a rotary motion by means of a second drive, of the means for moving the suction means, which is attached to the first drive.

7. The apparatus of claim 4, wherein at least one wall of the magazine is displaceable for the purpose of centering the stacked sheets in the magazine.

8. The apparatus of claim 6, wherein at least one wall of the magazine is displaceable for the purpose of centering the stacked sheets in the magazine.

* * * * *